United States Patent [19]

Gartside

[11] Patent Number: 4,474,486

[45] Date of Patent: Oct. 2, 1984

[54] APPARATUS FOR STAMPING CHARACTERS ON A WORKPIECE IN MULTIPLE ROWS

[75] Inventor: Roger H. Gartside, Glenshaw, Pa.

[73] Assignee: The Pannier Corporation, Pittsburgh, Pa.

[21] Appl. No.: 419,542

[22] Filed: Sep. 17, 1982

[51] Int. Cl.[3] ..... B41J 1/38; B41F 17/24

[52] U.S. Cl. ..... 400/134; 400/161; 400/320; 400/332.6; 400/332.5

[58] Field of Search ..... 400/128, 134, 332.5, 400/332.1, 332.6, 182, 127, 129, 130–133, 134.1, 134.2, 320, 161, 161.1; 101/18, 21, 4

[56] References Cited

U.S. PATENT DOCUMENTS

| | | | |
|---|---|---|---|
| 1,735,252 | 11/1929 | Kiely | 400/134 |
| 3,291,041 | 12/1966 | Burchfield et al. | 400/161 X |
| 3,739,899 | 6/1973 | Brumbaugh et al. | 400/332.6 X |
| 4,198,170 | 4/1980 | Decker | 400/320 X |
| 4,214,520 | 7/1980 | Eissel | 101/4 |

FOREIGN PATENT DOCUMENTS

| | | | |
|---|---|---|---|
| 47030 | 3/1982 | European Pat. Off. | 101/4 |
| 1027832 | 2/1953 | France | 400/332.5 |

*Primary Examiner*—Clifford D. Crowder
*Attorney, Agent, or Firm*—Robert D. Yeager

[57] ABSTRACT

A machine for stamping characters in multiple rows on a workpiece is disclosed. The machine includes an impact head assembly mounted on a transversely slidable carriage, the impact head assembly being adapted for reciprocating movement perpendicular to the path of that sliding movement. A rotating stamping wheel is mounted in the impact head assembly and has a plurality of character stamps mounted on its periphery. Means are disposed in the impact head assembly for moving the stamping wheel to a plurality of selected positions along its axis of rotation.

9 Claims, 12 Drawing Figures

Fig. 8.
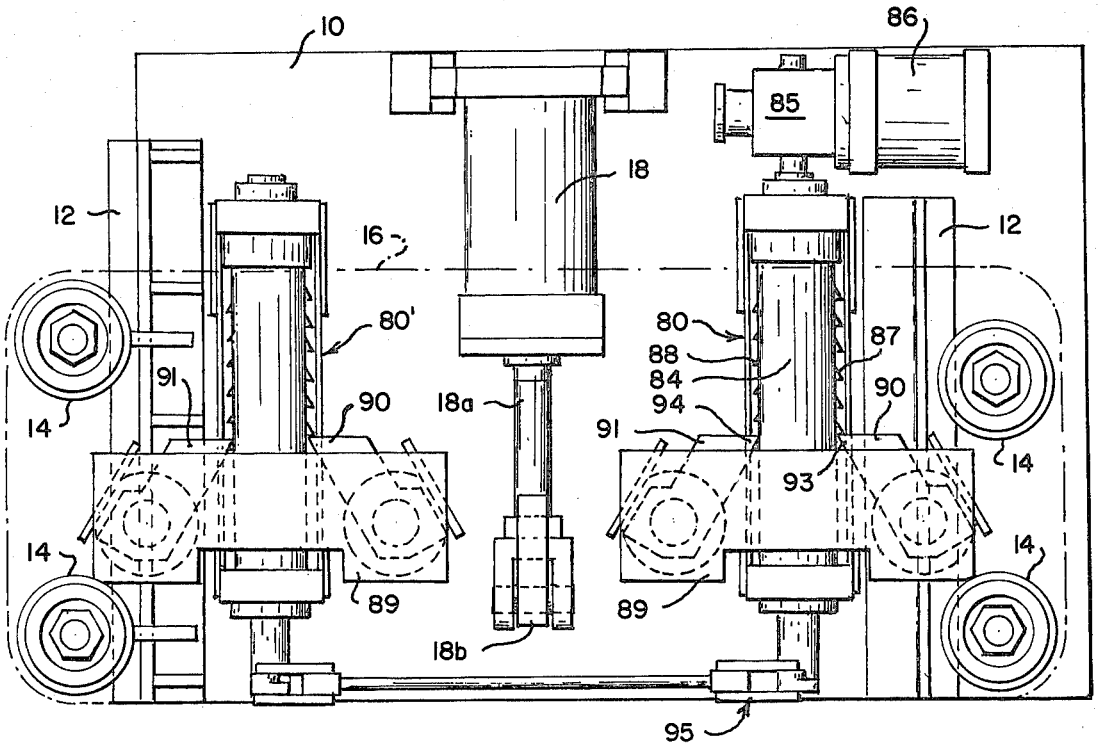
Fig. 9.
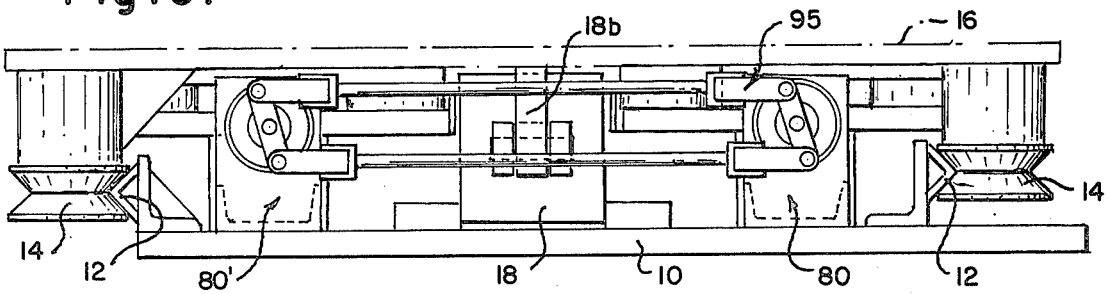
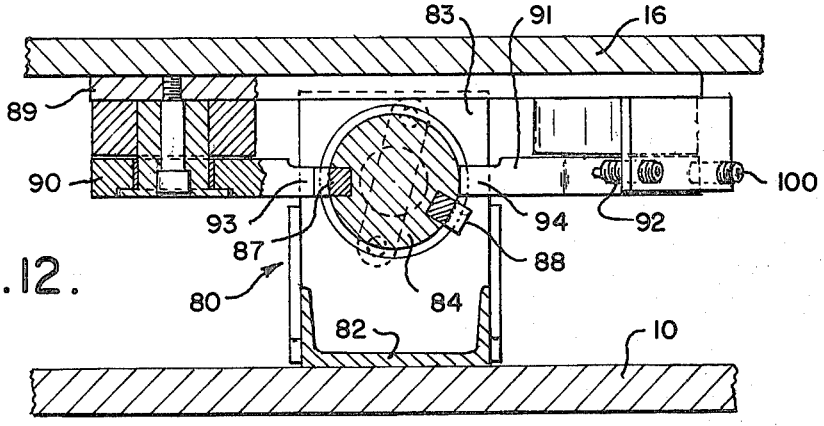
Fig. 12.

APPARATUS FOR STAMPING CHARACTERS ON A WORKPIECE IN MULTIPLE ROWS

BACKGROUND OF THE INVENTION

1. Field of the Invention

This invention relates to apparatus for stamping characters of a workpiece in a plurality of rows.

2. Description of the Prior Art

In the finishing of steel and other metals, it has become increasingly desirable to mark semi-finished items such as slabs, billets, bars and the like with identifying data while they are in a hot condition. This practice became particularly useful with the advent of the continuous casting machine from which strands of cast material proceed directly from the run-out lines of the caster into various rolling or drawing operations. The identifying data marked on the semi-finished products may indicate the composition or type of the product.

Machines for stamping identifying characters on a workpiece such as a hot steel slab or billet are well known. One such machine is described in U.S. Pat. No. 4,214,520. That machine employs a horizontally arranged stamping wheel (or toolholder) having 16 punch types (or characters) mounted on its periphery. After the appropriate character is selected by rotation of the stamping wheel, the wheel is thrust toward the workpiece and, upon contact by the punch type, a permanent mark is made in the surface of the workpiece. The stamping wheel is retracted and another character is selected. In the meantime, the machine is moved laterally in order to provide proper character spacing.

A disadvantage of the machine of U.S. Pat. No. 4,214,520 is that its structure permits the stamp of only one row of characters on a workpiece. For instance, a steelmaker may wish to apply identifying data to the end of a workpiece having restricted cross-sectional area. In order to stamp sufficient data on the workpiece, two or more vertically spaced rows of characters are needed but the U.S. Pat. No. 4,214,520 machin is incapable of filling that need. The structure of the U.S. Pat. No. 4,214,520 machine that is limiting in this regard is the fact that the stamping wheel is driven by a central rotating drive shaft and this arrangement admits of no vertical adjustability short of moving the entire machine vertically to obtain two or more rows of stamped characters. Obviously, the size and particularly the weight of such machines makes this type of vertical adjustability cumbersome, expensive and of questionable reliability.

SUMMARY OF THE INVENTION

The present invention overcomes the shortcomings associated with the known stamping machines by providing structure that conveniently allows adjustment of the stamping wheel along its axis of rotation and thus permits the stamping of multiple rows of characters on a workpiece. The stamping machine of the present invention also includes a novel mechanism for moving the machine transversely of its stamping stroke.

The present invention provides apparatus for stamping characters on the surface of a workpiece in a plurality of rows comprising: a base; a carriage mounted on the base for movement parallel the surface of the workpiece; an impact head assembly mounted on the carriage and adapted for reciprocating movement perpendicular to the path of movement of the carriage; a rotatable stamping wheel mounted in the impact head assembly and having a plurality of character stamps mounted on its periphery; and means disposed in the impact head assembly for moving the stamping wheel to a plurality of selected positions along its axis of rotation. Preferably, the stamp holder comprises a disk mounted for rotation about a nonrotatable axle, the axle being mounted for sliding movement within the impact head assembly. Preferably, the means for moving the disk along its axis of rotation includes piston means connected to the axle for longitudinally moving the axle to a plurality of positions, and means operatively engaging the disk to prevent axial movement thereof along the axle. Also preferably the means for indexing the disk includes a wide-faced gear connected to the disk and being in axial alignment therewith, a pinion engageable with the wide-faced gear throughout its range of movement with the disk, and means for driving the pinion, which preferably includes a controllable servomotor.

Also provided is apparatus for incrementally moving the stamping machine of the present invention or other object comprising: a rotatable shaft disposed in confronting relationship with the object to be moved and supported independently therefrom; two rows of aligned teeth mounted longitudinally on the shaft and being circumferentially spaced from one another by an angle of more than 90° and less than 180°, the teeth of one of the rows being longitudinally staggered in relation to the teeth of the other of the rows; a pair of pawls connected to the object to be moved and disposed on opposite sides of the shaft in coplanar relationship, the pawls having engaging surfaces adapted to alternately engage the teeth of the aligned rows as the shaft is oscillated through the supplement of the angle of spacing between the pawls; means for urging the object in a direction toward the engaging surfaces of the teeth; and means for oscillating the shaft.

BRIEF DESCRIPTION OF THE DRAWINGS

For a better understanding of the present invention, reference may be had to the preferred embodiments exemplary of the invention shown in the accompanying drawings in which:

FIG. 8 is an elevational view taken on the line VIII—VIII of FIG. 1 and illustrating the means for accomplishing transverse movement of the stamping machine of the present invention;

FIG. 9 is a front elevational view of FIG. 8;

FIG. 12 is a sectional view taken along the line XII—XII of FIG. 10.

DESCRIPTION OF THE PREFERRED EMBODIMENTS

Figure 1:
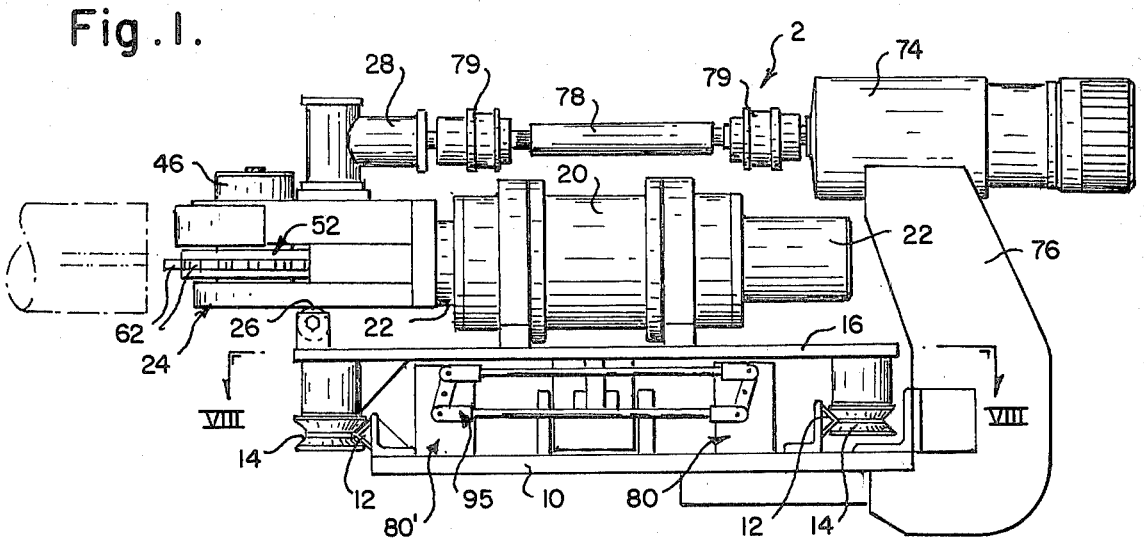
FIG. 1 is a side elevational view of a stamping machine.
Figure 2:
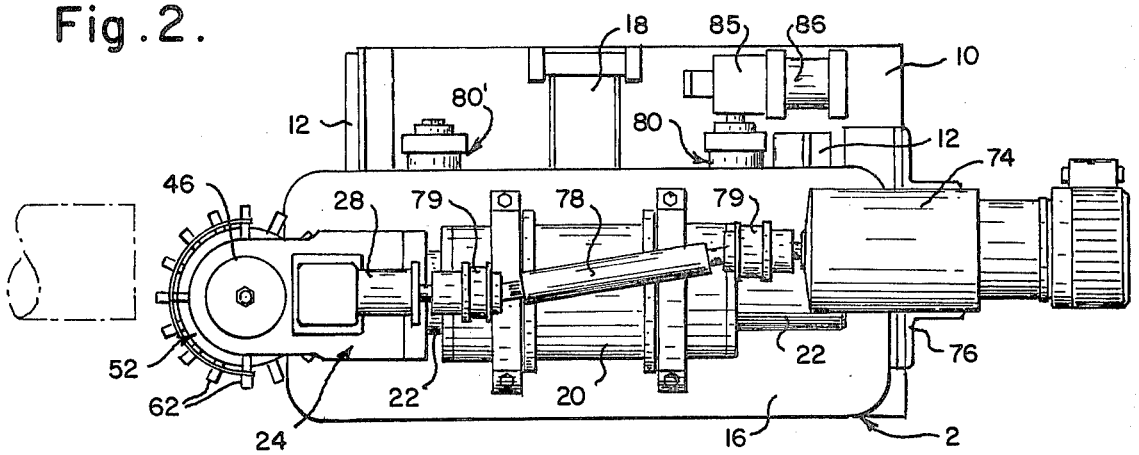
FIG. 2 is a top plan view of the stamping machine shown in FIG. 1.

Referring to the drawings, particularly to FIGS. 1–6, there is shown a stamping machine, generally designated by the reference numeral 2. Stamping machine 2 is mounted on base 10 which would be suitably anchored to the floor or other rigid support. A pair of transversely extending parallel tracks 12 are mounted on base 10. Tracks 12 are adapted to engage guide rollers 14 which are attached to the underside of carriage 16. This arrangement permits carriage 16 to move transversely of base 10 by the action of air cylinder 18. The transverse movement of carriage 16 is accomplished by means described hereinbelow.

Mounted on carriage 16 is longitudinally extending air cylinder 20 having a piston rod 22 that is affixed through bolts 23 to an impact head assembly generally designated by the reference numeral 24. Impact head assembly 24 is supported for longitudinal reciprocation with piston rod 22 by means of a roller 26 that is mounted on carriage 16. Roller 26 also serves to prevent rotation of piston rod 22. Mounted at the top of impact head assembly 24 is a right-angle drive unit 28 which, along with its associated components, will be described hereinbelow.

Referring particularly to FIGS. 3–6, impact head assembly 24 includes upper and lower frame members 30 and 32, respectively, rigidly connected in spaced relationship through spacer block 33 and end plate 34. A nonrotatable shaft 36, having an enlarged lower end portion 38, is slidably mounted in aligned openings 40 and 42 of frame members 30 and 32, respectively. Shaft 36 is prevented from rotating by means of slidable keying means 44. Rigidly connected to the top of upper frame member 30 by means of bolts 45 is a double-acting air cylinder 46 having piston means 48 movable therein. Piston means 48 is coaxially aligned with shaft 36 and rigidly connected thereto by means of bolt 50. Accordingly, reciprocal movement of piston mean 48 causes corresponding reciprocation of shaft 36.

A character stamping wheel generally designated by the reference numeral 52 is mounted for rotation about shaft 36 through bushing 54. Stamping wheel 52 is prevented from axial movement on shaft 36 by means of upper and lower thrust washers 56 and 58 and snap ring 60. Stamping wheel 52 is adapted for carrying at its perimeter replaceable stamps 62, each having a desired embossed character. Each stamp 62 is secured in position by upwardly extending bolt 64. The number of stamps 62 on stamping wheel 52 depends on the size of the stamps and the diameter of stamping wheel 52. A wide-faced gear 66 is coaxially mounted atop stamping wheel 52 by means of bolts 68.

Wide-faced gear 66 is adapted to engage, at its periphery, the teeth of a pinion 70. Pinion 70 is keyed to the output shaft 72 of right-angle drive unit 28. Accordingly, rotation of output shaft 72 causes rotation of stamping wheel 52 through pinion 70 and wide-faced gear 66. It should be noted that wide-faced gear 66 and pinion 70 are dimensioned to permit continuous engagement throughout the range of sliding motion of shaft 36.

Right-angle drive unit 28 is of conventional construction and is driven by indexing servomotor 74, which is mounted on base 10 by means of support arms 76, through a telescoping spline drive shaft 78 and constant velocity universal joints 79. This arrangement permits stationary servomotor 74 to remain connected to stamping wheel 52 throughout the stamping stroke. Preferably, servomotor 74 and its associate control systems (not shown) is of the type sold by the Control Systems Research Division of Contraves Goerz Corporation under the trademark Index-Syn. By means of the drive system just described, stamping wheel 52 may be caused to rotate through the shortest arcuate movement to the next desired character stamp 62. It has been found that the preferred drive system requires no separate locking means to hold the desired character in position during the stamping operation described hereinbelow.

As alluded to above, longitudinal reciprocation of impact head assembly 24 is accomplished by the action of piston rod 22 upon actuation of air cylinder 20.

Referring to FIGS. 8–12, the means for accomplishing transverse movement of carriage 16 now will be described in detail. Rigidly mounted on base 10 are a pair of ratchet and pawl assemblies generally designated by the reference numerals 80, 80'. Ratchet and pawl assemblies 80, 80' are identical in construction and operation, and are arranged to operate synchronously in a manner soon to be described. Accordingly, it will be necessary to describe only one ratchet and pawl assembly 80, which is the driven one.

Ratchet and pawl assembly 80 includes a mounting frame 81 comprising a channel member 82 and a pair of upstanding end plates 83. Mounted for rotation within end plates 83 is a shaft 84. Shaft 84 is driven through right-angle drive 85 by pneumatic rotary actuator 86. Right-angle drive 85 may include suitable stop means for limiting the rotation of shaft 84 through an arc of about 30° in either direction. Mounted longitudinally to the outside surface of shaft 84 are two ratchet racks 87 and 88, respectively. The teeth of ratchet racks 87, 88 are longitudinally staggered. As best shown in FIG. 12, ratchet rack 88 is mounted 30° below the extension of the diameter passing through ratchet rack 87. Therefore, the angular spacing between ratchet racks 87 and 88 on the underside of shaft 84 is about 150°; the supplementary angle, therefore, is about 30°. Upon actuation of rotary actuator 86, shaft 84 rotates counterclockwise (as viewed in FIG. 12) to cause ratchet rack 88 to assume a position on the extension of the diameter passing through ratchet rack 87 in its initial position. In this new position of shaft 84, ratchet rack 87 asssumes a position 30° below its initial position.

Suspended from carriage 16 are a pair of pawl mounting brackets 89. Each mounting bracket 89 spans the longitudinal axis of shaft 84. Pivotally mounted on each side of mounting bracket 89 are a pair of inwardly extending pawls 90 and 91, respectively. Pawls 90, 91 are biased by spring cartridge 92 to urge their engaging tips 93 and 94, respectively, toward shaft 84. Engaging tips 93, 94 are prevented, however, from contacting the surface of shaft 84 by stop screws 100. As best shown in FIG. 12, when ratchet rack 87 is in the position shown, engaging tip 93 of pawl 90 is in engagement with one of the teeth of ratchet rack 87. In this position, the engaging tip 94 of pawl 91 is out of engagement with the teeth of ratchet rack 88.

Air cylinder 18 includes a piston rod 18*a* whose end is connected to carriage 16 through a clevis and pin arrangement generally designated 18*b*. Accordingly, movement of piston rod 18*a* will cause corresponding movement of carriage 16.

The operation of the nondriven ratchet and pawl assembly 80' is accomplished through a well-known parallel link arrangement 95 best shown in FIG. 9. Thus, any rotary motion imparted to shaft 84 of ratchet and pawl assembly 80 is transmitted directly to shaft 84 of ratchet and pawl assembly 80'. This dual arrangement, though not essential, prevents any tendency toward misalignment or binding that might otherwise result from cylinder 18 being offset from shaft 84.

If it be desired to move carriage 16 transversely of base 10, the sequence of operation of the components just described is as follows. Viewing FIG. 8, carriage 16 is shown in its extreme extended position. In this position, constant air pressure is applied within air cylinder 18 to the rod side of the piston thereby urging air cylinder 18 to its most contracted position. However, carriage 16 is held in the extreme position shown by reason of the firm engagement between engaging tip 93 of pawl 90 with a tooth on ratchet rack 87. Should transverse movement (upwardly in FIG. 8) of carriage 16 be desired, rotary actuator 86 is actuated to rotate shaft 84 through an arc of about 30° in a counterclockwise direction as shown in FIG. 12. Upon rotation of shaft 84, engaging tip 93 of pawl 90 moves out of engagement with ratchet rack 87 and to a position 30° below its initial position. At the same time, ratchet rack 88 moves upwardly and is there engaged by engaging tip 94 of pawl 91. Because of the staggering of the teeth of ratchet racks 87 and 88, an incremental transverse movement of carriage 16 is thereby accomplished. Any shock occurring by the impact of this transverse movement is absorbed by a polyurethane bumper 96 (see FIG. 10). Should further transverse movement of carriage 16 in the same direction be desired, rotary actuator 86 is actuated in the opposite direction to cause ratchet rack 88 to move out of engagement with engaging tip 94 of pawl 91 and thereby to assume its initial position shown in FIG. 12. At the same time, ratchet rack 87 moves upwardly about 30° to a position shown in FIG. 12 and there engages engaging tip 93 of pawl 90. All of the movements and engagements of parts experienced in indexing assembly 80 are, of course, duplicated in indexing assembly 80'. It will be appreciated by those skilled in the art that the arcuate movement of shaft 84 should be related to the width of the teeth of ratchet racks 87, 88. In other words, it is preferred that one of engaging tips 93, 94 of pawls 90, 91, respectively, always be in position for potential engagement with the next tooth of a ratchet rack during the oscillation of shaft 84.

Should it be desired to reverse the movement of carriage 16 toward its intial position shown in FIG. 8, air pressure is applied to the backside of the piston within air cylinder 18 causing an extension of piston rod 18*a*. Upon such extension, the engaging tip of the then engaged pawl simply rides over the teeth of the engaged ratchet rack, against the urging of spring cartridge 92, to permit movement of carriage 16 in that direction. The actuation of rotary actuator 86 to permit transverse movement of carriage 16 is, of course, synchronized with the actuation of air cylinder 20 which furnishes the stamping action of impact head assembly 24. In other words, the transverse movements of carriage 16 are accomplished while impact head assembly 24 is in its retracted or rest position. If it is desired to stamp a workpiece while it is moving past the location of stamping machine 2, the transverse movement of carriage 16 may be unnecessary because the movement of the workpiece may be used to achieve proper character spacing. In such case, carriage 16 may be eliminated from the structure of stamping machine 2.

Figure 7:
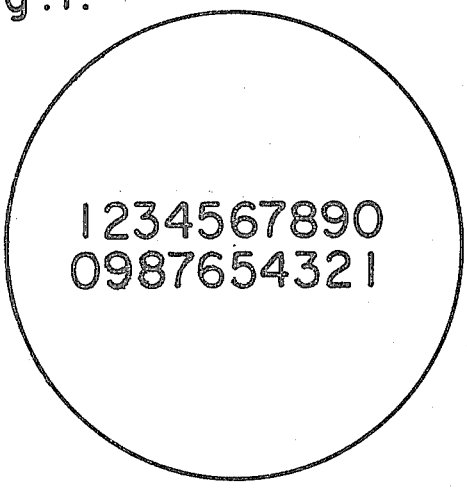
FIG. 7 is representative of a double line of characters imprinted by the stamping machine of the present invention.
Figure 3:
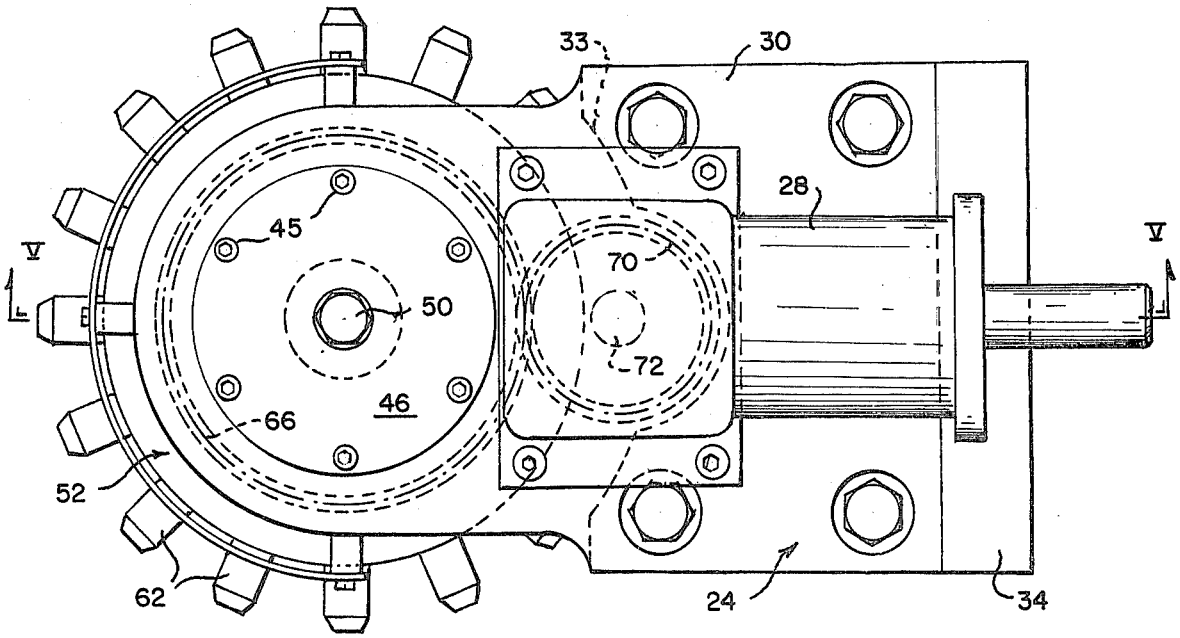
FIG. 3 is an enlarged top plan view of the impact head assembly of the stamping machine of FIG. 1.
Figure 4:
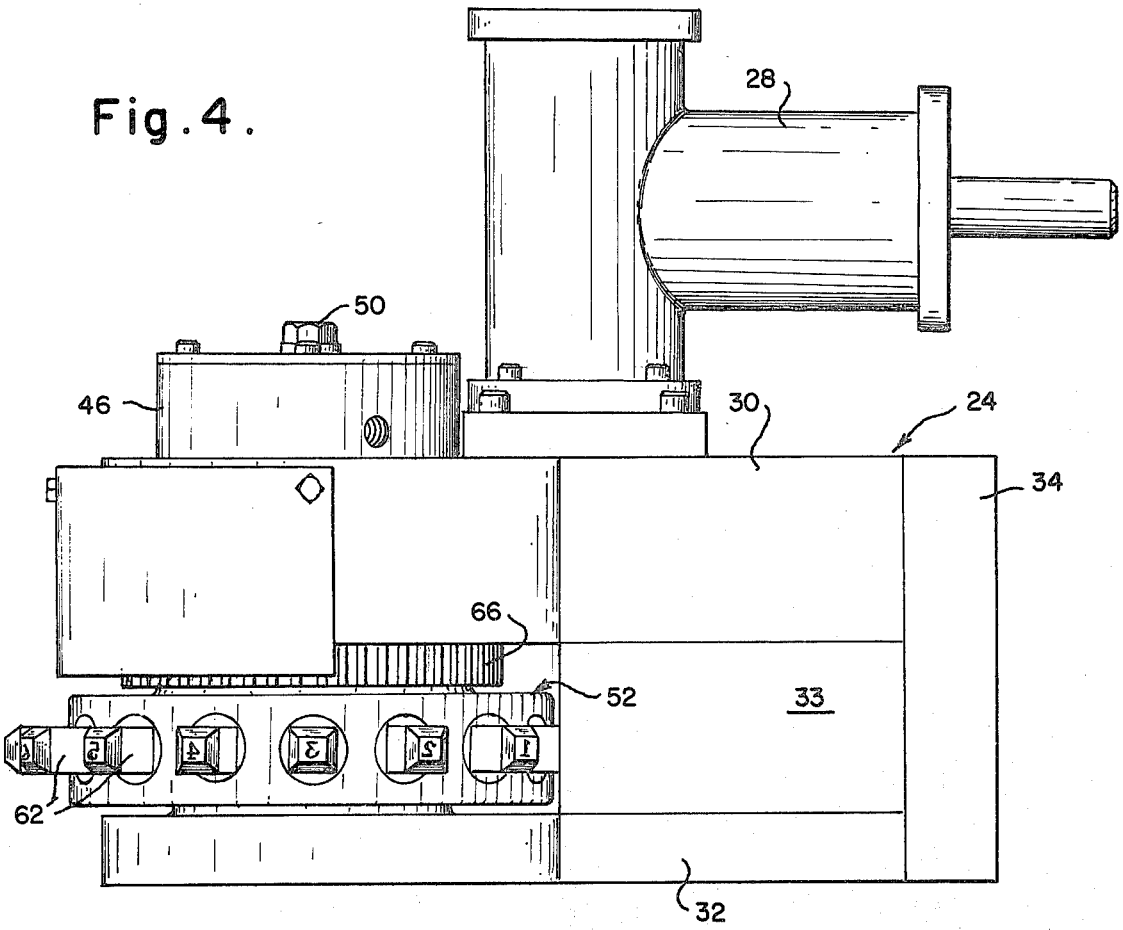
FIG. 4 is a side elevational view of the impact head assembly shown in FIG. 3.

The overall operation of stamping machine 2 will now be described. Stamping machine 2 will be located, say, adjacent a run-out table of a continuous slab casting machine. Through an appropriate machine control consol, stamping machine 2 may be programmed to stamp a slab soon to stop its location with appropriate identifying information, say the two rows of numbers shown in FIG. 7. As the slab surface to be stamped stops at stamping machine 2, servomotor 74 is actuated to rotate stamping wheel 52 through the shortest arcuate distance to position the character stamp "1" in the stamping position. Stamping wheel 52, at this time, is in the "up" position shown in FIG. 6 and thus the top row of characters will be stamped first. At the appropriate time, air cylinder 20 is actuated to extend piston rod 22 and thrust impact head assembly 24 toward the slab surface. Upon impact, the character "1" is indented on the slab surface. Air cylinder 20 is actuated to reverse and retract piston rod 22 and return impact head assembly to its rest position. Because the drive train between servomotor 74 and stamping wheel 52 remains intact during the stamping stroke, stamping wheel 52 may be rotated by servomotor 74 during the return stroke to select the character "2".

When impact head assembly reaches the rest position, rotary actuator 86 is actuated to cause appropriate transverse movement of carriage 16 to the right in order to achieve appropriate spacing between the "1" and the "2". The stamping procedure described above then is repeated to stamp the character "2" on the slab surface. Again rotary actuator 86 is actuated to cause further transverse movement of carriage 16 and so on.

Figure 5:
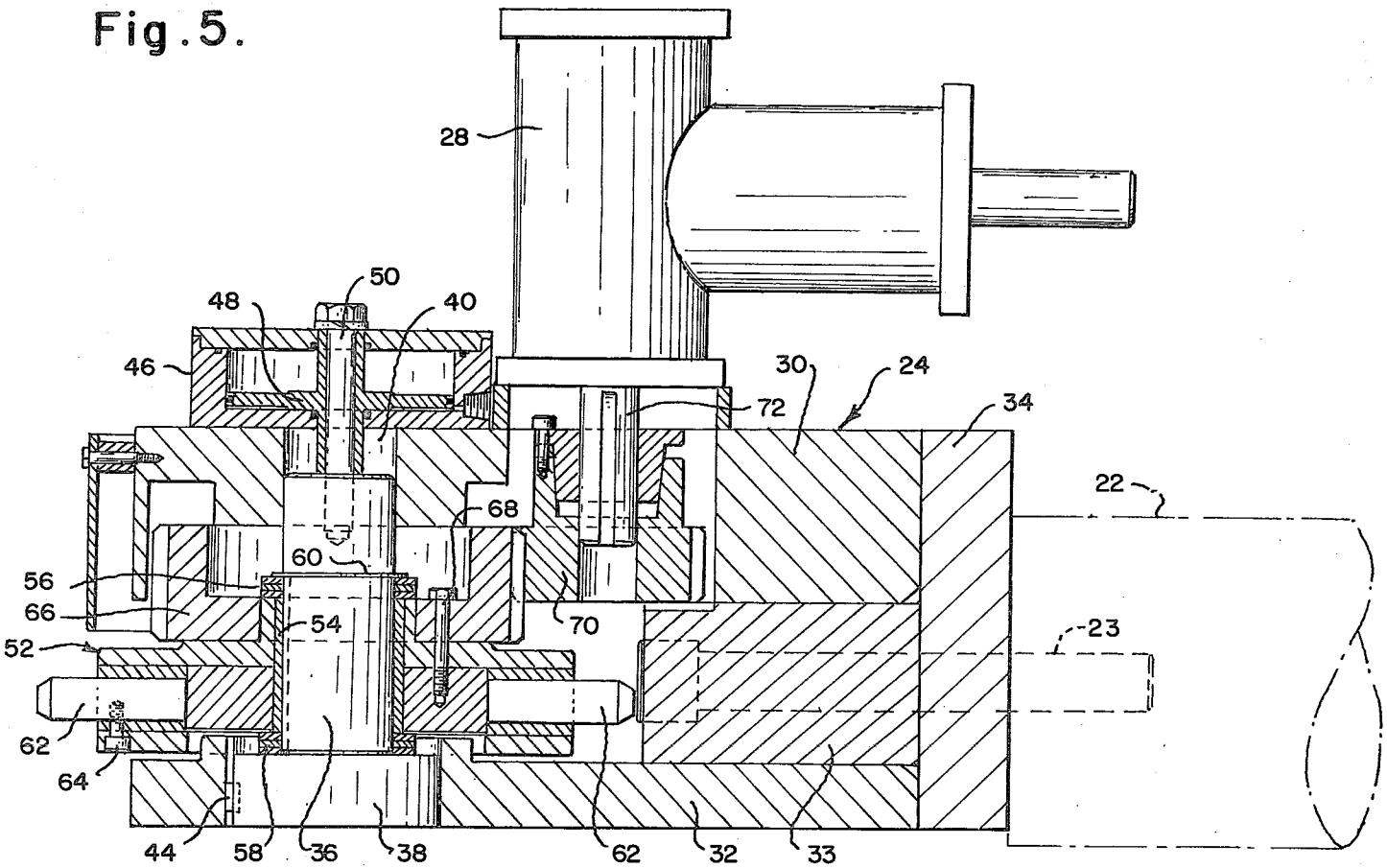
FIG. 5 is a longitudinal sectional view of the impact head assembly of FIG. 3, taken along line V—V of FIG. 3.
Figure 6:
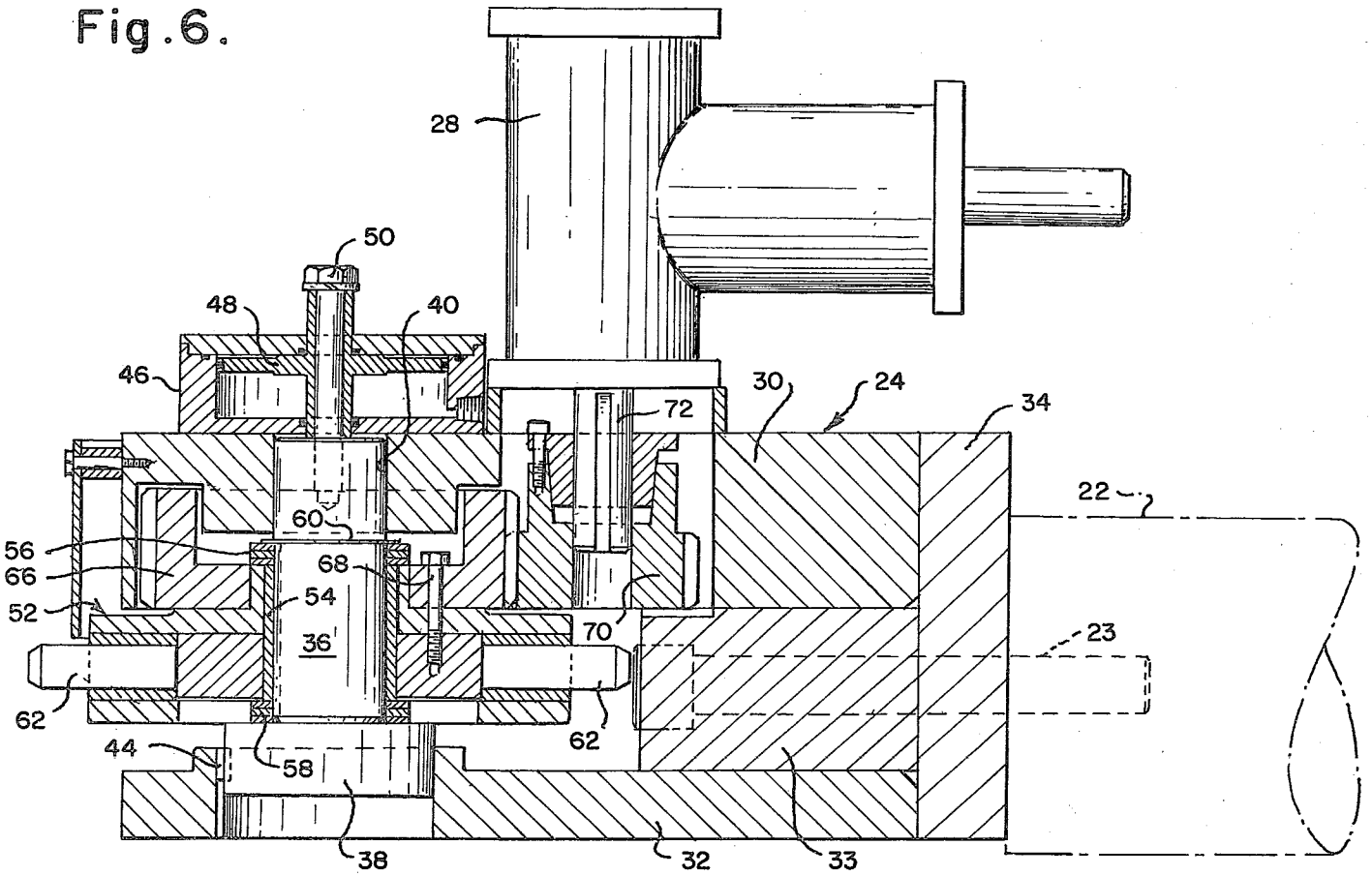
FIG. 6 is a longitudinal sectional view similar to FIG. 5 with the stamping wheel in a raised position.
Figure 10:
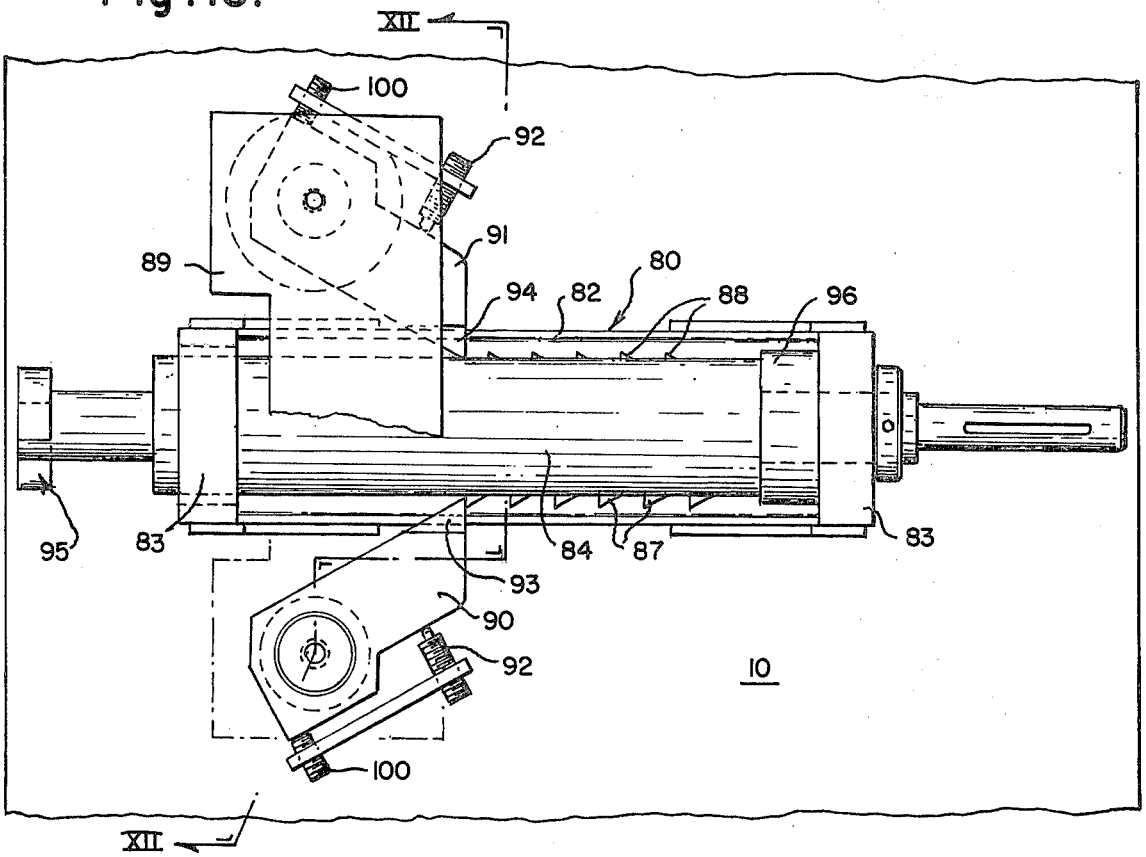
FIG. 10 is an enlarged top elevational view of one of the ratchet and pawl indexing assemblies shown in FIG. 8.
Figure 11:
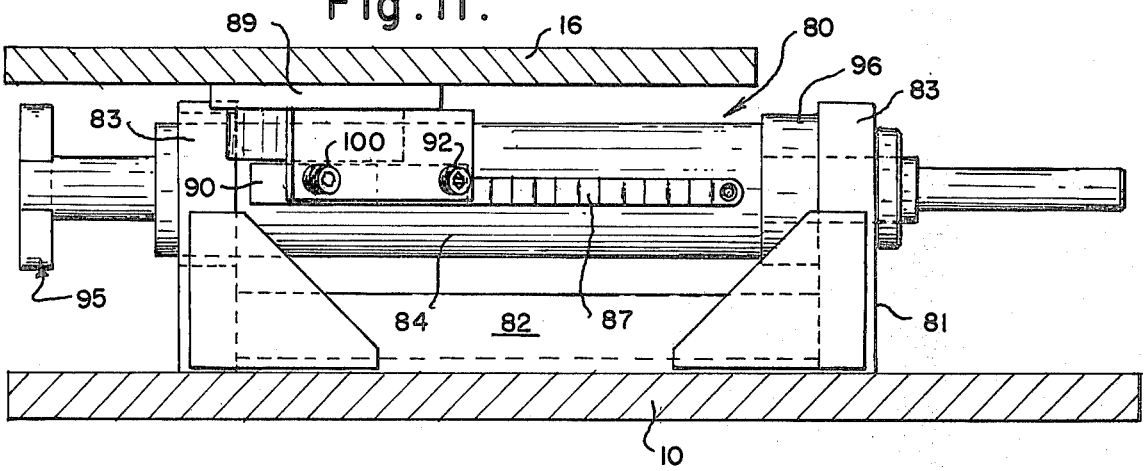
FIG. 11 is a side elevational view of FIG. 10.

After the last character in the top row is stamped, the "0", air cylinder 46 is actuated to extend piston means 48 and thereby move shaft 36 downwardly to its lowermost position shown in FIG. 5. The movement of shaft 36 causes corresponding downward movement of stamping wheel 52 to a position suitable for stamping the bottom row of characters shown in FIG. 7. It will be appreciated by those skilled in the art that, under appropriate circumstances, stamping wheel 52 may be moved to positions intermediate the positions shown in FIGS. 5 and 6, and thus stamp more than two vertically spaced rows of characters. With stamping wheel 52 in the lower position, carriage 16 is returned to its extreme left position by the procedures described above. Then the procedures described above are repeated in sequence to stamp the bottom row of characters shown in FIG. 7 onto the slab surface.

The stamping machine of the present invention may be variously configured to vary the stamping operation. For example, the stamping of characters may be from left to right or from right to left. By appropriate control, the machine can always stamp either an upper row or a lower row of characters first.

What is claimed is:

1. Apparatus for stamping characters in a plurality of vertically spaced rows on the surface of workpiece comprising:

a base;

a carriage mounted on said base for movement generally parallel to the said surface of said workpiece;

an impact head assembly mounted on said carriage for reciprocating movement generally perpendicular to the surface of said workpiece;

a nonrotatable axle mounted within said impact head assembly;

a stamp holder adapted to releasably support a plurality of stamping members on its periphery and being mounted for rotation about said nonrotatable axle;

means mounted on impact head assembly for moving said stamp holder along its axis of rotation to a plurality of positions;

means mounted on said carriage for reciprocating said impact head assembly;

means for indexing said stamp holder to position a selected stamping member for contact with said workpiece upon movement of said impact head assembly toward said workpiece; and means, synchronously operative with said impact head reciprocating means, for moving said carriage to selected positions along its path of movement.

2. Apparatus as recited in claim 1 wherein:

said stamp holder comprises a disk; and said nonrotatable axle is mounted for sliding movement within said impact head assembly.

3. Apparatus as recited in claim 2 wherein said means for moving said disk along its axis of rotation comprises:

piston means connected to said axle for longitudinally moving said axle to a plurality of positions; and means operatively engaging said disk to prevent axial movement thereof along said axle.

4. Apparatus as recited in claim 3 wherein:

said means for indexing said disk includes a wide-faced gear connected to said disk and in axial alignment therewith; a pinion engageable with said wide-faced gear throughout its range of movement with said disk; and means for driving said pinion.

5. Apparatus as recited in claim 4 wherein:

said pinion driving means includes a controllable servomotor mounted independently of said carriage and the components supported thereby.

6. Apparatus as recited in claim 1 wherein:

said means for moving said carriage includes at least one ratchet and pawl assembly.

7. Apparatus as recited in claim 6 wherein said ratchet and pawl assembly comprises:

a rotatable shaft mounted on said base beneath said carriage and in parallel alignment with the path of movement of said carriage;

a pair of ratchet racks longitudinally mounted on said shaft in a generally opposed relationship but circumferentially offset from the plane containing both the central axis of said shaft and the longitudinal axis of either one of said racks, said racks having teeth that are longitudinally staggered;

a pair of coplanar pawls mounted on said carriage on opposite sides of said shaft and adapted to alternately engage said ratchet racks as said shaft reversably rotates to bring said ratchet racks into the plane of said pawls; and means, synchronously operative with said means for reciprocating said impact head assembly, for reversably rotating said shaft.

8. Apparatus for stamping characters on the surface of a workpiece in a plurality of rows comprising:

a base;

an impact head assembly mounted on said base and adapted for reciprocating movement perpendicular to said surface of said workpiece;

a nonrotatable axle mounted within said impact head assembly;

a rotatable stamping wheel mounted on said nonrotatable axle and having a plurality of character stamps mounted on its periphery; and means disposed in said impact head assembly for moving said stamping wheel to a plurality of selected positions along said nonrotatable axle.

9. Apparatus for incrementally moving an object comprising:

a rotatable shaft disposed in confronting relationship with said object to be moved and supported independently therefrom;

two rows of aligned teeth mounted longitudinally on said shaft and being circumferentially spaced from one another by an angle of more than 90° and less than 180°, the teeth of one of said rows being longitudinally staggered in relation to the teeth of the other of said rows;

a pair of pawls connected to said object to be moved and disposed on opposite sides of said shaft in coplanar relationship, said pawls having engaging surfaces adapted to alternately engage the teeth of said aligned rows as said shaft is oscillated through the supplement of the said angle of spacing between the pawls;

means for urging said object in a direction toward the engaging surfaces of said teeth; and means for oscillating said shaft.

* * * * *

UNITED STATES PATENT AND TRADEMARK OFFICE

CERTIFICATE OF CORRECTION

PATENT NO. : 4,474,486

DATED : October 2, 1984

INVENTOR(S) : Roger H. Gartside

It is certified that error appears in the above—identified patent and that said Letters Patent is hereby corrected as shown below:

Col. 1, line 40, delete "machin" and substitute therefor --machine--;

Col. 3, line 42, delete "mean" and substitute therefor --means--;

Col. 4, line 7, delete "Index-Syn" and substitute therefor --INDEX-SYN--.

Signed and Sealed this

*Nineteenth* Day of *March 1985*

[SEAL]

*Attest:*

DONALD J. QUIGG

*Attesting Officer*

*Acting Commissioner of Patents and Trademarks*